US005805709A

United States Patent [19]

Liou

[11] Patent Number: 5,805,709

[45] Date of Patent: Sep. 8, 1998

[54] DESKTOP MICROPHONE BASE

[76] Inventor: I-Chang Liou, 3F, No. 1-62, Lane 81, Yuan Dong St., Long Jing Hsian, Taichung Hsien, Taiwan

[21] Appl. No.: 840,659

[22] Filed: Apr. 25, 1997

[51] Int. Cl.[6] ..... H04R 25/00

[52] U.S. Cl. ..... 381/169; 381/168; 381/188; 381/205

[58] Field of Search ..... 381/169, 168, 381/205, 188, 68.5; 379/426–433

[56] References Cited

U.S. PATENT DOCUMENTS

| | | | |
|---|---|---|---|
| 2,924,661 | 2/1960 | Messeas, Jr. | 381/188 |
| 3,153,123 | 10/1964 | Harman | 381/169 |
| 3,375,333 | 3/1968 | Hagopian | 381/169 |
| 3,452,955 | 7/1969 | Hartwig | 381/205 |
| 3,562,446 | 2/1971 | Wolf | 381/169 |
| 4,853,965 | 8/1989 | Blonski | 381/169 |
| 4,991,220 | 2/1991 | Wolf | 381/188 |
| 5,115,470 | 5/1992 | Sutheim | 381/188 |
| 5,469,505 | 11/1995 | Gattey et al. | 381/187 |
| 5,633,942 | 5/1997 | Terng | 381/169 |

*Primary Examiner*—Curtis A. Kuntz
*Assistant Examiner*—Rexford N. Barnie
*Attorney, Agent, or Firm*—Browdy and Neimark

[57] ABSTRACT

A desktop microphone base is composed of a base body and a pivoting member. The base is provided with a receptacle having a plurality of retaining portions capable of holding securely a pivoting portion of the pivoting member. The pivoting portion is provided with a neck extending therefrom and having at the free end thereof a holding portion for holding a microphone. The microphone can be located at will.

8 Claims, 3 Drawing Sheets

DESKTOP MICROPHONE BASE

FIELD OF THE INVENTION

The present invention relates generally to a desktop microphone, and more particularly to a base of the desktop microphone.

BACKGROUND OF THE INVENTION

As shown in FIG. 1, a desktop microphone of the prior art is provided with a base 1 having a flexible tube 2 fastened therewith for holding a retaining tube 3 to secure a microphone 4. Such a prior art desktop microphone as described above is defective in design in that the flexible tube 2 is vulnerable to fatigue, and that the microphone 4 can not be located precisely at a desired level.

SUMMARY OF THE INVENTION

It is therefore the primary objective of the present invention to provide an improved desktop microphone base, which enables a user to adjust the position of the microphone at will.

It is another objective of the present invention to provide an improved desktop microphone base which is simple in construction and can be assembled easily.

In keeping with the principle of the present invention, the foregoing objectives of the present invention are attained by a desktop microphone base, which is composed of a base body and a pivoting member. The base body is provided with a receptacle. The pivoting member is provided at one end thereof with a pivoting portion engageable with the receptacle of the base body, and at another end thereof with a neck for holding a microphone.

The foregoing objectives, features, functions, and advantages of the present invention will be more readily understood upon a thoughtful deliberation of the following detailed description of the present invention in conjunction with the accompanying drawings.

DETAILED DESCRIPTION OF THE INVENTION

As shown in FIGS. 2–7, a desktop microphone base embodied in the present invention is composed of a base body 20, and a pivoting member 40.

Figure 1:
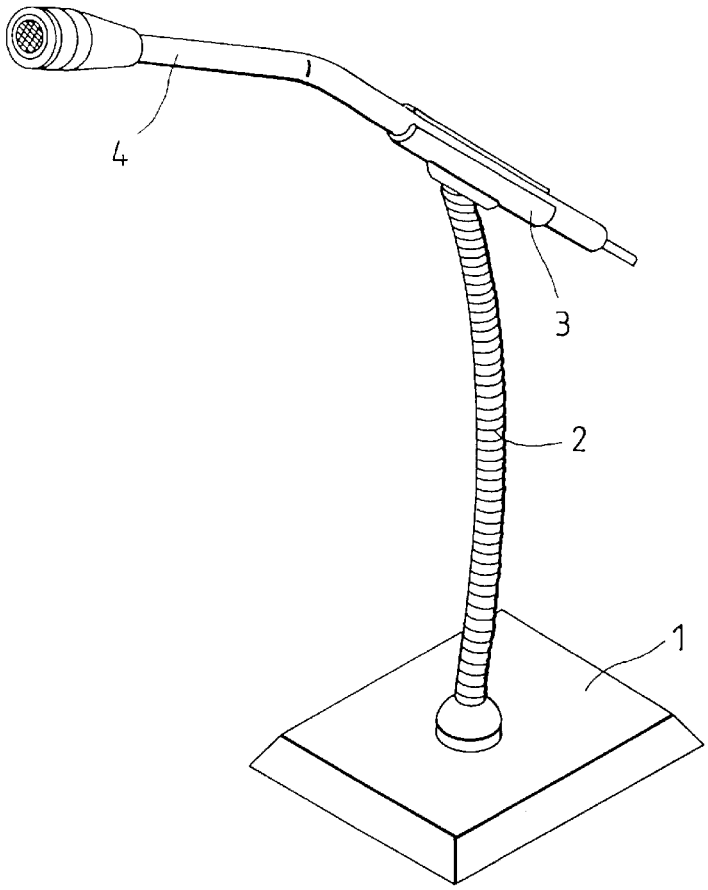
FIG. 1 (PRIOR ART)
FIG. 1 shows a perspective view of a desktop microphone base of the prior art.
Figure 2:
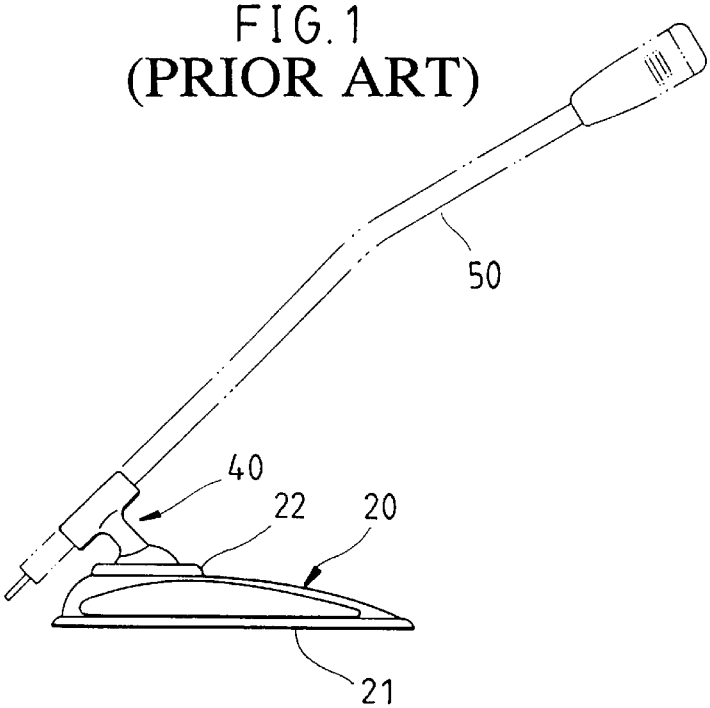
FIG. 2 shows a perspective view of a desktop microphone base of the present invention.
Figure 3:
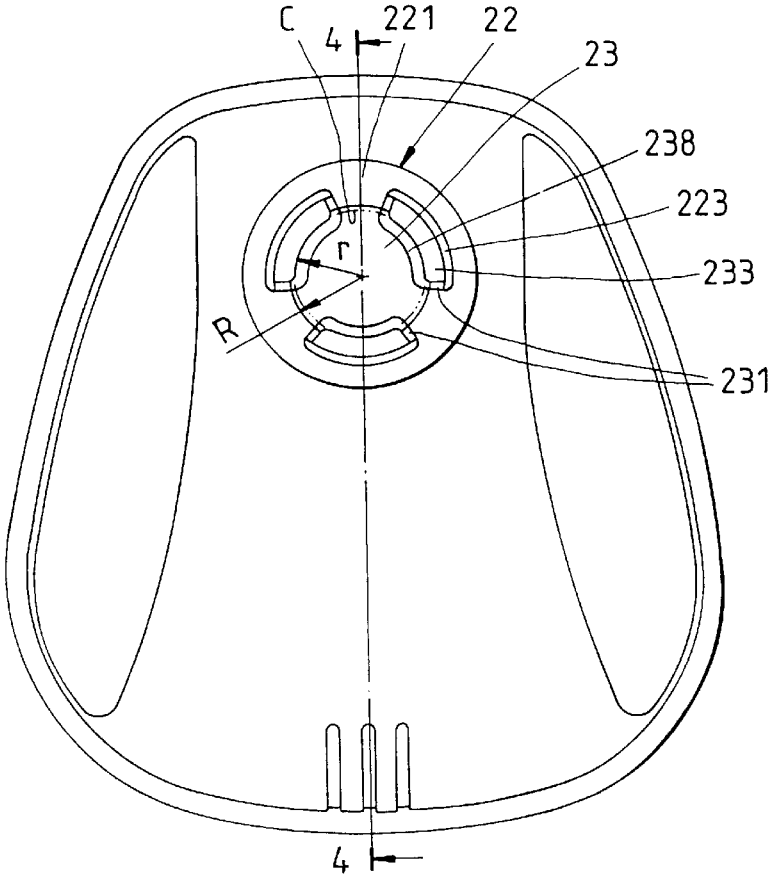
FIG. 3 shows a top view of the base body of the desktop microphone base of the present invention.
Figure 4:
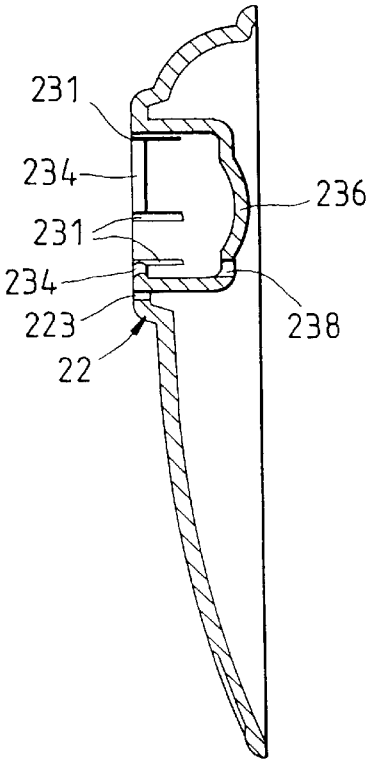
FIG. 4 shows a sectional view taken along the direction indicated by a line 4—4 as shown in FIG. 3.
Figure 5:
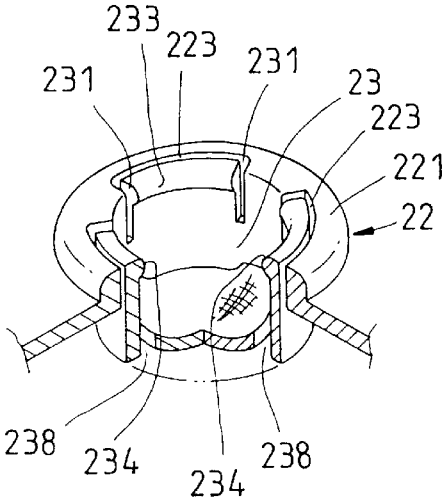
FIG. 5 shows a broken perspective view of the base body of the present invention.
Figure 6:
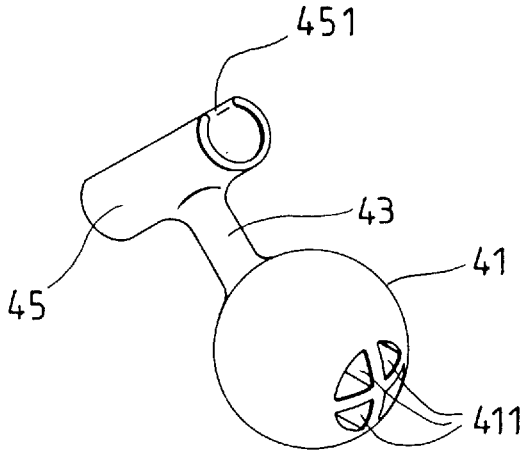
FIG. 6 shows a schematic perspective view of the pivoting member of the present invention.

The base body 20 is made integrally of a plastic material and is provided with a flat underside 21 for making contact with a desk top. The base body 20 is progressively thickened towards one end which is provided with a circular protuberance 22 located on the upper side of the base body 20. The circular protuberance 22 has an upper side 221 provided with a receptacle 23 of a columnar construction. The receptacle 23 is provided in the brim thereof with three arcuate slots 223 separated equidistantly. The receptacle 23 is further provided with a plurality of furrows 231 extending downwards from both ends of each of the arcuate slots 223 for a predetermined depth. As a result, the receptacle 23 is provided with three retaining portions 233 which are separated equidistantly. Each retaining portion 233 is provided at the top edge thereof with a flat projection 234. The receptacle 23 has a radius R, which is slightly greater than a radius r of an imaginary circle (c) defined by the flat projections 234, as illustrated in FIG. 3. The receptacle 23 is still further provided in the bottom wall thereof with an arcuate recess 236, and in the periphery of the bottom wall thereof with three mold-releasing grooves 238 corresponding in location to the retaining portions 233.

The pivoting member 40 is provided at one end thereof with a pivoting portion 41 of a spherical construction. The pivoting portion 41 has a radius slightly greater than or equal to the radius R of the receptacle 23 of the base body 20. The pivoting portion 41 has a neck 43 extending obliquely therefrom. The neck 43 is provided at the free end thereof with a holding portion 45 tubular in shape for holding a microphone 50 on a desk top. The wall of the tubular holding portion 45 is split along the direction of a longitudinal axis of the tubular holding portion 45 into two portions between which a lengthwise slit 451 is formed.

Figure 7:
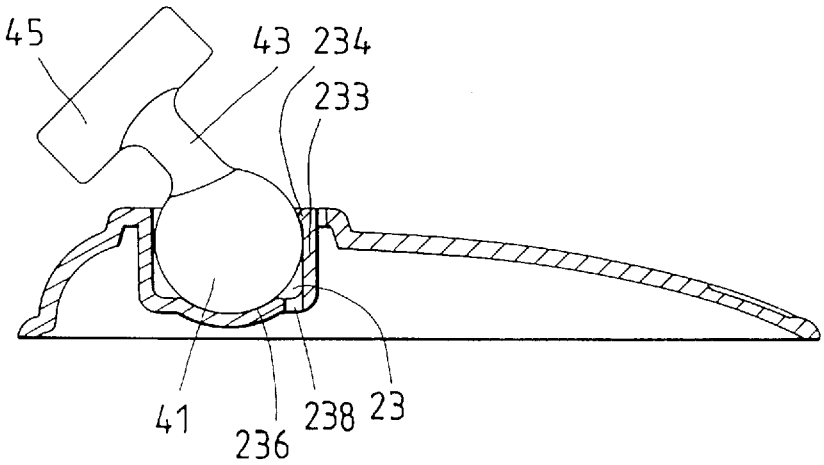
FIG. 7 shows a sectional view of the present invention in combination.

In combination, the spherical pivoting portion 41 of the pivoting member 40 is forced into the resilient receptacle 23 of the base body 20 such that the spherical pivoting portion 41 is rested in the arcuate recess 236 of the bottom wall of the receptacle 23, as illustrated in FIG. 7. In view of the fact that the radius of the pivoting portion 41 is greater than or equal to the radius of the receptacle 23, the retaining portions 233 of the receptacle 23 are so squeezed as to accommodate the pivoting portion 41 of the pivoting member 40 when the pivoting portion 41 is forced into the receptacle 23. The pivoting portion 41 is therefore held securely by the retaining portions 233 of the receptacle 23 such that the pivoting portion 41 is effectively prevented from becoming disengaged with the receptacle 23. The position of the microphone 50 can be adjusted as desired by turning the pivoting member 40 until such time when the microphone 50 is located at a desired position. The pivoting member 40 is always retained securely by the retaining portions 233 of the receptacle 23 when the pivoting member 40 is turned.

It must be noted here that the pivoting portion 41 of the pivoting member 40 of the present invention is provided with a plurality of cavities 411 for preventing the deformation of the pivoting portion 41, which is subjected to the thermal stress during the molding process.

On the basis of the above detailed description of the present invention, it is readily apparent that the desktop microphone base of the present invention is simple in construction. In addition, a microphone mounted on the present invention can be located with ease and precision.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A desktop microphone base comprising:

a base body provided with a receptacle, said receptacle having in an inner wall thereof a plurality of retaining portions separated equidistantly; and a pivoting member having a pivoting portion engageable with said receptacle such that said pivoting portion is held securely by said retaining portions of said receptacle, and further that said pivoting portion can be rotated inside said receptacle, said pivoting member further having a neck extending therefrom such that said neck is provided at a free end thereof with a means for holding adjustably a microphone;

wherein said base body is provided in a protuberance thereof with a slot between the base body and each of said plurality of retaining portions and furrows extending between said base body and each of said plurality of retaining portions from two opposite ends of each said slot towards a bottom wall of said receptacle for a predetermined length.

2. The desktop microphone base as defined in claim 1, wherein said retaining portions of said receptacle are provided respectively at a top edge thereof with a flat projection.

3. The desktop microphone base as defined in claim 1, wherein said receptacle is provided in a bottom wall thereof with an arcuate recess.

4. The desktop microphone base as defined in claim 1, wherein said receptacle has a circular cross section; and wherein said retaining portions are preferably three in number and separated equidistantly.

5. The desktop microphone base as defined in claim 1, wherein said pivoting portion of said pivoting member is spherical in shape.

6. The desktop microphone base as defined in claim 1, wherein said means of said neck of said pivoting member for holding the microphone is tubular in shape and provided with a lengthwise slit.

7. The desktop microphone base as defined in claim 1, wherein said receptacle is provided in a bottom wall periphery thereof with a plurality of mold-releasing grooves corresponding in location to said retaining portions of said receptacle.

8. The desktop microphone base as defined in claim 1, wherein said pivoting portion of said pivoting member has at least one cavity for preventing the deformation of said pivoting portion by thermal stress.

* * * * *